United States Patent [19]

McFarland

[11] 4,199,541

[45] Apr. 22, 1980

[54] CONCRETE METHOD AND EQUIPMENT

[76] Inventor: George E. McFarland, 1133 W. Tamarisk St., Phoenix, Ariz. 85041

[21] Appl. No.: 894,496

[22] Filed: Apr. 7, 1978

[51] Int. Cl.[2] ..... E01C 11/00

[52] U.S. Cl. ..... 264/34; 404/96; 404/98

[58] Field of Search ..... 404/15, 16, 93, 97, 404/118–120, 96, 98; 425/218, DIG. 811; 52/174; 264/34

[56] References Cited

U.S. PATENT DOCUMENTS

| | | | |
|---|---|---|---|
| 1,034,074 | 7/1912 | Cannell | 404/96 |
| 1,843,746 | 2/1932 | Tibbetts | 404/15 |
| 2,021,767 | 11/1935 | Church | 404/96 |
| 2,187,080 | 1/1940 | Heltzel | 404/98 |
| 2,575,678 | 11/1951 | Olson | 264/31 |
| 2,616,145 | 11/1952 | Dufford | 264/34 X |

*Primary Examiner*—Thomas P. Pavelko

*Attorney, Agent, or Firm*—Harry M. Weiss

[57] ABSTRACT

Method and equipment for producing a convex riser in concrete flat work. The apparatus includes a frame and shaper which are utilized to produce risers of controlled uniformity.

3 Claims, 5 Drawing Figures

CONCRETE METHOD AND EQUIPMENT

BACKGROUND OF THE INVENTION

This invention relates to the production of concrete roadways and more particularly to the production of risers therein.

In producing concrete flatwork such as streets, sidewalks, tracks and the like there is a need for riser sections therein. For example, a vehicle test track may require a series of risers to simulate bumps, potholes or similar road hazards. In streets or shopping center parking lots risers may be put in to slow traffic speed and limit the danger to pedestrians. In sidewalks across driveways, risers may be required to serve as berms for irrigation water.

In the past such risers have been usually produced after the major flatwork has been finished and cured. Thus, the riser became merely an attachment to the major flatwork instead of an integral part thereof. Even if the flatwork is acid treated or otherwise conditioned prior to placement of the riser thereon, its adherency thereto is still nominal.

On the other hand, if the attempt is made to produce the riser while the flatwork is being formed, working on or in the wet concrete, or long handled instruments are required. Risers produced by such methods are very unsatisfactory from both a workman and resultant product standpoint. In the production of test tracks, for example, the risers must be uniformly placed and of uniform shape and height as well. The required uniform preciseness is not attainable by such completely manual methods.

SUMMARY OF THE INVENTION

It is an object of this invention to provide integral risers on concrete flatwork.

It is a further object of the invention to provide a process and apparatus for producing risers on uncured concrete flatwork.

It is a further object of the invention to provide a process and equipment for convex risers on streets, tracks and sidewalks.

It is still a further object of the invention to provide a process and apparatus for producing risers which are precisely placed and shaped.

In accordance with these objects there is provided a frame defining an opening having a horizontal cross-sectional area of the riser to be produced. The frame has at least two support arms extending horizontally from corners thereof. A shaper having a length complementary with a dimension across the frame opening has a concavity therein which is complementary with the desired shape of the riser.

To produce the riser, the riser frame is placed on uncured concrete flatwork. Concrete having a slump of about 4 is poured into the frame to a dome-shape. The filling material is then shaped generally into the convex shape with the shaper tool having the concave cross-section generally complementary to the desired shape of the riser. After the frame is removed, the filling is then worked into the shape of the finished riser by troweling.

THE FIGURES

Further objects and advantages of the invention will be understood from the following complete description thereof and from the drawings wherein:

FIG. 3 is a similar view depicting shaping of the riser; with

Figure 3:
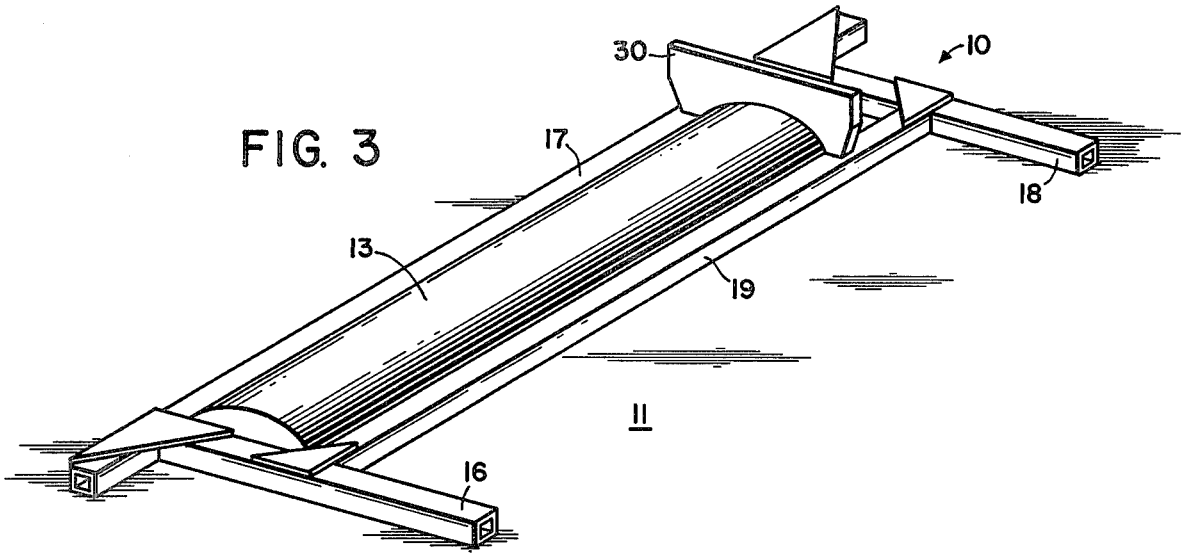

FIG. 3(*a*) depicting a side view of the shaping tool; and

Figure 4:
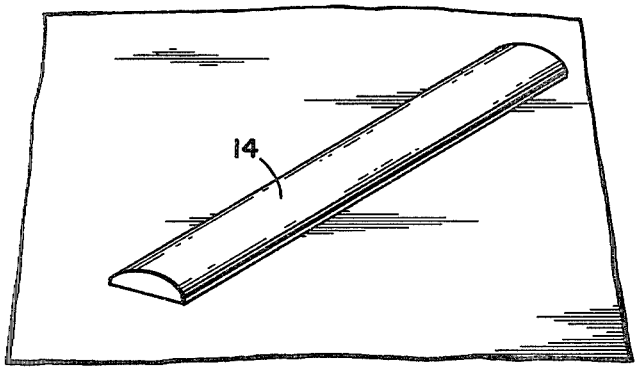

FIG. 4 is a perspective view of the finished work.

COMPLETE DESCRIPTION

As noted above, in producing concrete flatwork such as streets, sidewalks, tracks and the like there is a need for riser sections therein. For example, a vehicle test track may require a series of risers to simulate bumps, potholes or similar road hazards. In streets or shopping center parking lots risers may be put in to slow traffic speed and limit the danger to pedestrians. In sidewalks across driveways, risers may be required to serve as berms for irration water.

Figure 1:
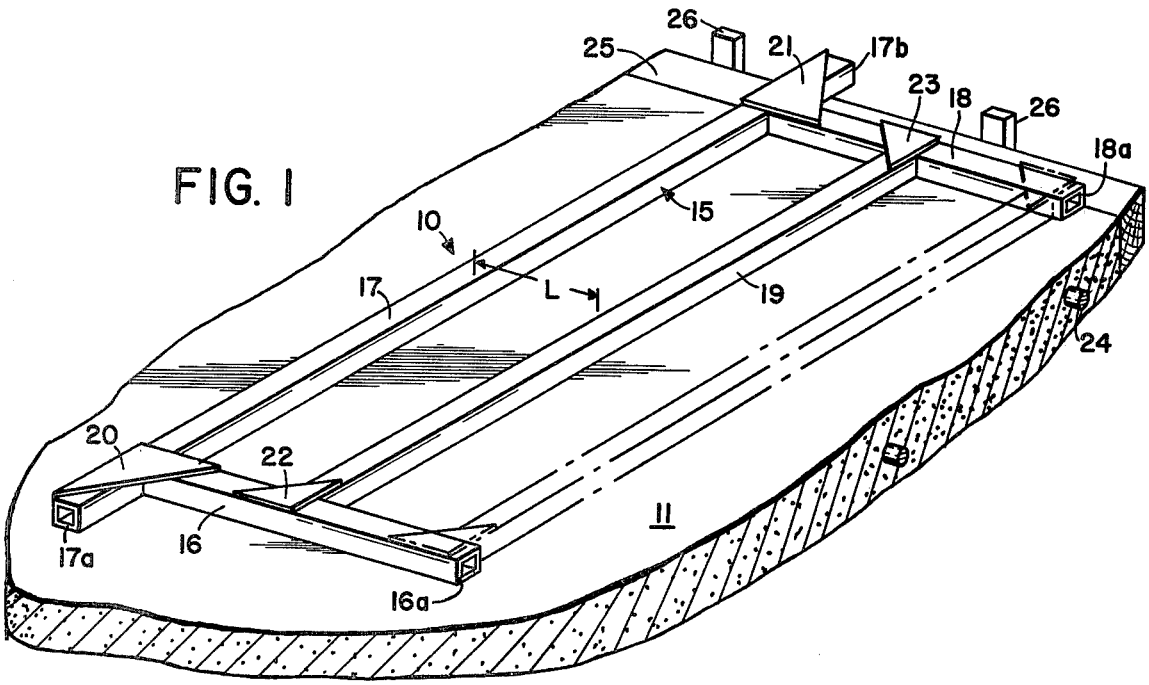
FIG. 1 is a perspective view of a roadway with a riser frame thereon.
Figure 2:
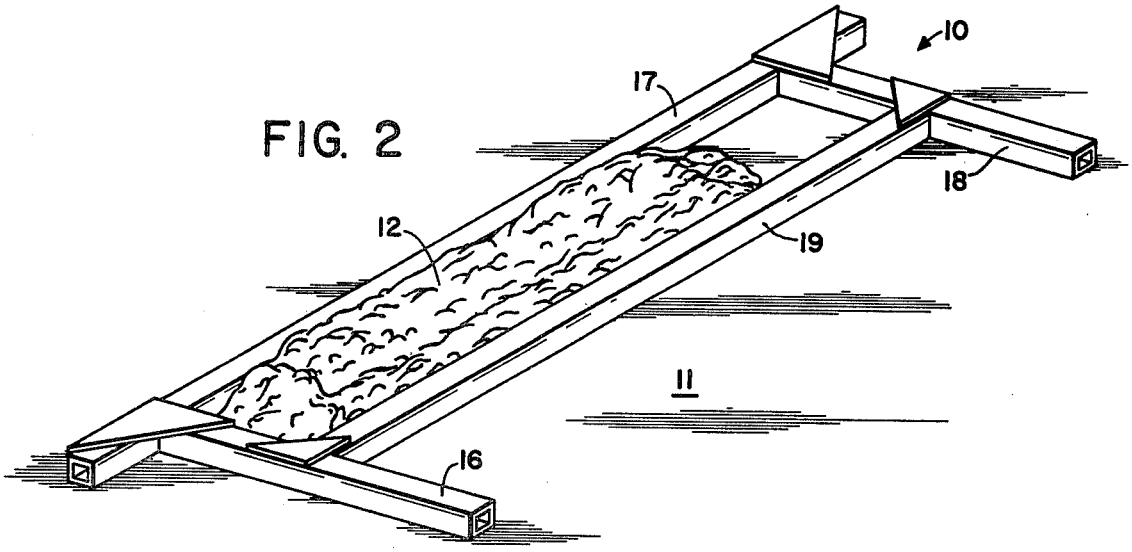
FIG. 2 is a perspective view with the concrete filling in place.
Figure 3A:
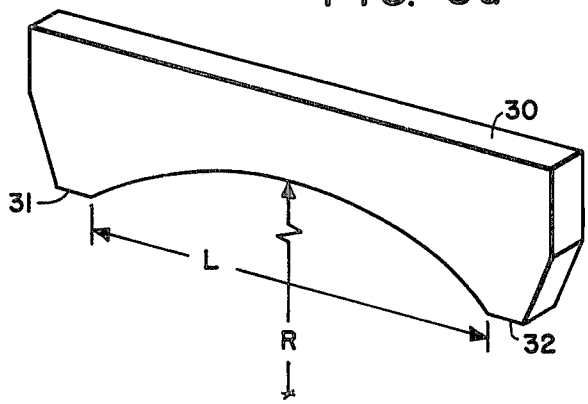

In accordance with the invention, a method of producing a convex riser in concrete flatwork includes a first step of placing a riser frame 10 on uncured concrete flatwork such as a road bed 11 (FIG. 1). The frame is then generally filled with concrete material 12 having a slump of about 4 (FIG. 2). The filling material 12 is then shaped a general dome shape 13 of the riser (FIG. 3) with a shaper 30 (FIG. 3*a*) having a concave cross-section complementary to the shape of the desired riser. The frame is then removed and the filling worked into the shape of a finished riser 14 by hand troweling (FIG. 4).

Apparatus for producing the convex riser 14 in the concrete flatwork 11 includes the frame 10 which defining an opening 15 (FIG. 1) having a horizontal cross-sectional area the same as the riser 14 to be produced therewith.

The opening 15 in the frame 10 is defined by structural side members 16, 17, 18 and 19. Each of the members 16–19 may be constructed of hollow rectangular tubes of steel or aluminum for example, to make the frame lightweight but sturdy. Members 16 and 18 are engaged with member 17 by triangular corner plates 20 and 21. The corner plates 20 and 21 are respectively permanently secured to members 16 and 17 and to members 18 and 17, for example, by welding. Triangular corner plates 22 and 23 may be similarly welded to the intersection corners formed by member 19 with members 16 and 18. However, preferably corner plates 22 and 23 are only permanently secured to member 19 to overly and slideably engage members 16 and 18 so as to be adjustable. Thus, the width of the riser 14 to be produced may be readily varied as shown by the phantom position. It should be noted that if the expected requirement of adjustability were to be in a length direction corner plates 20 and 22 could be made slideable and corner plates 21 and 23 fixed.

In any case, the fixed corner plates 21 and 20 overly extensions 17*a* and 17*b* of member 17 and are large relative to slideable corner plates 22 and 23. The extensions 17*a* and 17*b* allow for securing of the corners without interference with the opening 15 which determined the area of the riser. Member 16 and 18 have extensions 16*a* and 18*a* which allow the width of opening 15 to be varied.

The frame 10 is resting on poured and smoothed concrete roadbed 11 having reinforcement 24 placed therein. If desired the risers 14 may contain some similar reinforcements. The roadbed is surrounded by framing member 25 secured by posts 26 as is conventional.

The shaper 30 (FIG. 3*a*) has a length L complementary with a dimension across the frame opening 14 and concavity formed by a radius R therein complementary with the shape of the convex riser. This tool is preferably made of wood and readily made to the opening dimension L of the curvature desired for the particular riser desired. This includes a pair of legs 31 and 32 which slideably engage with members 17 and 19 as the riser is formed (FIG. 3).

While the invention has been described by way of the preferred embodiment thereof, it will be appreciated that suitable modifications may be made therein without departing from the spirit and scope of the invention.

What is claimed is:

1. A method of producing a riser in and integral with concrete flatwork, said riser having a length which is longer than the wheel base of a standard vehicle and a width substantially smaller than its length, said riser being positioned across a regular path of vehicular travel so as to be engaged by said vehicle comprising the steps of placing a riser frame having said length and said width on the uncured concrete flatwork, said frame positioned across said path of vehicular travel;

generally filling the frame with concrete having a slump of about 4 in the shape of a dome;

shaping the filling material into the general shape of the riser with a shaper having a cross-section complementary to the shape of the desired riser;

removing the frame; and working the dome-shaped filling into the finished riser.

2. A method of producing a riser in concrete flatwork as recited in claim 1 and including the steps of troweling the filling after the frame is removed into shape of the finished riser.

3. A method for producing a riser in concrete flatwork as recited in claim 1 wherein the frame defines an opening having the horizontal cross-sectional area of the riser to be produced therewith; and said frame having at least two support extension arms extending horizontally therefrom.

* * * * *